United States Patent [19]

Tagnon

[11] Patent Number: 4,628,798

[45] Date of Patent: Dec. 16, 1986

[54] AIR HEATER AND DISTRIBUTOR UNIT

[76] Inventor: Claude Tagnon, 23, rue du Commandant Mouchotte, 94160 Saint-Mande, France

[21] Appl. No.: 838,182

[22] Filed: Mar. 4, 1986

Related U.S. Application Data

[63] Continuation of Ser. No. 656,223, Oct. 1, 1984, abandoned.

[30] Foreign Application Priority Data

Oct. 4, 1983 [FR] France ..... 83 15767

[51] Int. Cl.[4] ..... F24F 7/00

[52] U.S. Cl. ..... 98/31.6; 126/99 R; 237/69

[58] Field of Search ..... 126/72, 109, 99 R; 237/12.3 A, 12.3 B, 46, 69; 98/40 B, 40 R, 40 V, 31.6

[56] References Cited

U.S. PATENT DOCUMENTS

| | | | |
|---|---|---|---|
| 2,332,762 | 10/1943 | Stempel et al. . | |
| 2,364,265 | 12/1964 | Brickman | 98/40 V X |
| 3,347,146 | 10/1967 | Samuelsson et al. | 98/40 B |
| 3,777,650 | 12/1973 | Wenig | 98/40 V |

FOREIGN PATENT DOCUMENTS

| | | |
|---|---|---|
| 1191536 | 4/1965 | Fed. Rep. of Germany . |

*Primary Examiner*—Larry Jones

*Attorney, Agent, or Firm*—Sandler & Greenblum

[57] ABSTRACT

A unit heater for heating large volume premises. The heater includes a motor-ventilator unit mounted vertically in an expansion enclosure open at its upper and lower ends. Air is drawn downwardly through this expansion enclosure across a lower outlet orifice and a convex central bottom in the lower end of the enclosure. Air distribution is directed across fins with adjustable orientations. The heat exchange unit includes spirally-wound electric heating resistors, hot fluid radiators, or other equivalent means.

12 Claims, 4 Drawing Figures

AIR HEATER AND DISTRIBUTOR UNIT

This application is a continuation of application Ser. No. 656,223, filed Oct. 1, 1984 now abandoned.

BACKGROUND OF THE INVENTION

1. Field of the Invention

This invention relates to a unit heater for heating large volume premises.

2. Description of Pertinent Information

Various types of unit heaters are known that essentially comprise a motor-ventilator unit that blows air through an expansion enclosure across which a heat exhanger extends. Such unit heaters are designed to heat large volume premises such as workshops, and usually are disposed horizontally. As a consequence, these unit heaters produce at their outlets substantially horizontal currents of hot air. As this hot air naturally tends to rise, the layers of air in the premises tend to stratify, resulting in very high temperature differentials between the ceiling of the premises and the floor. Such a difference in temperature may be on the order of 15°-30° C.

Unit heaters must furnish a quantity of heat greater than or equal to the quantity of heat lost to maintain a given comfortable temperature inside the premises. The heat loss is of two types: a static loss through the walls and ceiling, and a dynamic loss through renewal of the inside air. Due to stratification caused by the rise of hot air, heat losses through the roof of the premises are very considerable.

Currents of hot air are directed towards persons working in such premises to ensure their comfort to a desirable degree. Each person's feeling of comfort, however, depends upon the temperature of the ambient air, the air speed, the hygrometric degree of the air, and the rte of radiation of the walls and ceiling. People may feel cold even if hot air is blown onto them when working in the premises due to a combination of these factors. It is often necessary to increase the temperature of the air leaving the unit heater to compensate for these factors. As the temperature of the air is raised, however, the hotter air tends to rise and to stratify more quickly. Past attempts to overcome these drawbacks have involved providing accessories for raising air from the floor, but these accessories have the drawback of being expensive, cumbersome, and inefficient.

Another solution also has been envisaged, which consists of disposing the unit heaters vertically. The drawbacks mentioned above, concerning the direct blowing of air on people located in the premises to be heated, are again encountered with such an arrangement.

SUMMARY OF THE INVENTION

The present invention overcomes the above-noted drawbacks by providing a unit heater of particularly simple design which makes it possible to obtain optimum comfort for people located in the premises to be heated by which the speed of the air at the outlet of the unit heater may be adapted very easily to the height of the unit heater with respect to the floor. To achieve such results, the unit heater of the present invention comprises an expansion enclosure open at its upper and lower ends and a motor-ventilator unit mounted across the upper orifice of the expansion enclosure in the upper end. This motor-ventilator blows air downwardly through this expansion enclosure across the lower outlet orifice in the lower end. The lower outlet orifice comprises a convex central bottom and, in the annular space defined between this convex central bottom and the wall of the enclosure, air distribution fins with adjustable orientations.

The unit heater according to the invention is advantageous in that it is very easy to vary the speed of the air at the level of the occupants of the premises as a function of the position of the distribution fins. These fins ensure a multi-directional distribution, at low air speed at the level of the occupants of the premises. Air from the unit heater is discharged at a higher speed as the unit heater is positioned at greater heights with respect to the floor. The multi-directional nature and speed of the air at the level of the occupants of the premises is simply controlled by varying the inclination of the distribution fins.

The unit heater accordingly to the invention may be used as a destratification apparatus. It also may be used as a heating apparatus, and in such a case comprises, inside the expansion enclosure, a heat exchanger scavenged by the air blown by the motor-ventilator unit. This heat exchanger preferably comprises a spirally-wound battery or heating coil that delivers at its outlet a homogeneous hot air flow without any turbulence.

BRIEF DESCRIPTION OF THE DRAWINGS

Various embodiments of the present invention will be described hereinafter by way of non-limiting example, with respect to the accompanying drawing, in whih like reference numerals are used to describe similar parts throughout, and wherein.

DETAILED DESCRIPTION OF PREFERRED EMBODIMENTS

Figure 1:
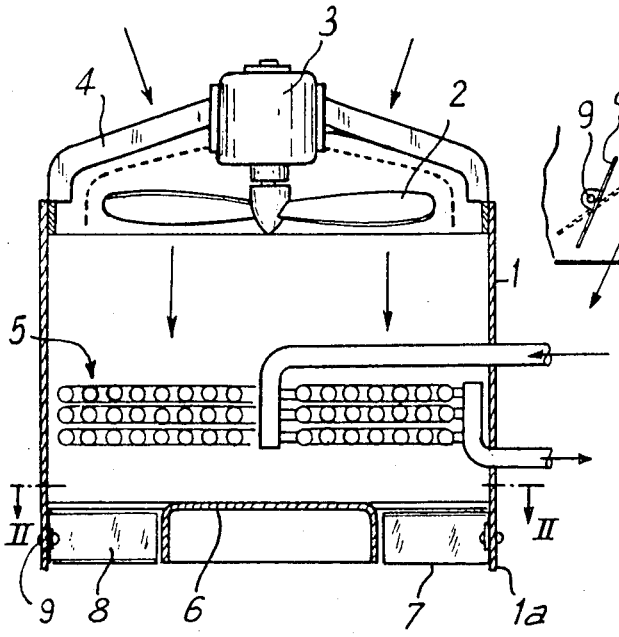
FIG. 1 is a schematic view along a vertical plane of a unit heater formed according to the invention.
Figure 2:
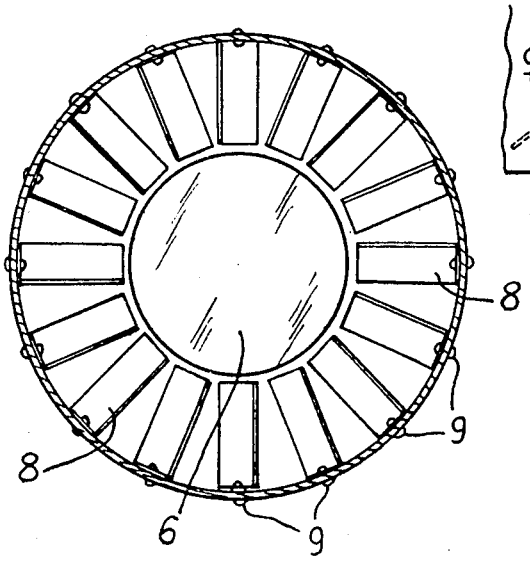
FIG. 2 is a horizontal sectional view taken along line II—II of FIG. 1.

The present invention relates to a unit heater for heating large volume premises as shown in FIGS. 1 and 2. The unit heater comprises a cylindrical expansion enclosure 1 open at its upper and lower ends. Across the upper orifice of enclosure 1 extends a motor-ventilator unit comprising a ventilator 2, which is rotatable about a vertical axis and which is driven in rotation by a motor 3. Motor 3 is supported by enclosure 1 by means of crosspieces 4. Motor-ventilator unit 3 is positioned to blow air downwardly as indicated by the arrows in FIG. 1.

When the unit heater according to the invention is used as a hot air generator, it comprises, inside enclosure 1 and below motor-ventilator unit 2, 3, a heat exchanger 5 that preferably comprises either a spirally-wound battery formed by tubes through which a heat-carrying fluid (i.e., water, vapor or gas) passes, or a spirally-wound electric heating resistor, or by any other equivalent means.

The unit heater includes, in its lower portion, a centrally positioned convex bottom 6 in the form of a cap with an inward/upstream convexity, i.e., positioned in the downward direction flow of the air. Convex bottom 6 is attached to the wall of enclosure 1 by any appropriate means such as tie-rods, crosspieces, or the like.

Central convex bottom 6 defines an annular space 7, with a lower circular edge 1*a* defining the inner orifice of enclosure 1, in which air distribution fins 8 which can be adjustably oriented are housed. Fins 8 are regularly spaced about a vertical axis of the unit heater, and each fin 8 is mounted to rotate about a horizontal, substantially radial axis 9. Axis 9 may be any means, such as a pivot, attached to the wall of enclosure 1 about which fins 8 rotate. Each fin 8 thus radially overhangs in the direction of central convex bottom 6. The inner end of each fin is located at a very short distance from bottom 6 and is separate therefrom. Air distribution fins 8 have an adjustable inclination about their respective axes 9.

Figure 3:
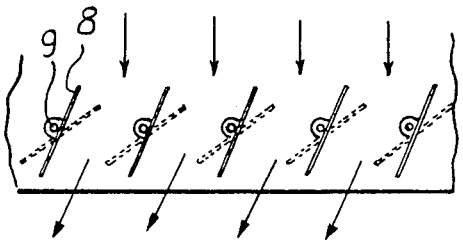
FIG. 3 is a cutaway developed view of planar distribution fins usable in the heater of FIG. 1.

As seen in FIG. 3, planar fins 8 articulate about their axes 9, these fins between them channels sewing as hot air outlets. The width of these channels varies as a function of the inclination of fins 8. When fins 8 are vertical, the width of the passage of each channel is maximum and corresponds to the space between the axes of rotation 9. Fins 8 are shown in solid lines in a position fairly considerably inclined on the horizontal, and in broken lines in a less inclined position from the horizontal. It is clear that in the less inclined position the section of passage of each channel is reduced; it is thus possible to vary the speed of discharge of hot air, indicated by arrows in FIG. 3, as a function of the orientation of fins 8.

The diameter of convex central bottom 6 is chosen as a function of the height at which the unit heater is to be used. If this unit heater is to be placed at a low height, for example, at four meters, convex bottom 6 then has a relatively small diameter so as to define, with the lower edge of enclosure 1, an annular outlet passage 7 of large area that gives a relatively low speed of hot air discharge.

On the contrary, if the unit heater is to be placed at a great height, for example, fifteen meters, the diameter of bottom 6 is greater so as to reduce the area of outlet passage 7 and to correspondingly increase the speed of hot air discharge.

Figure 4:
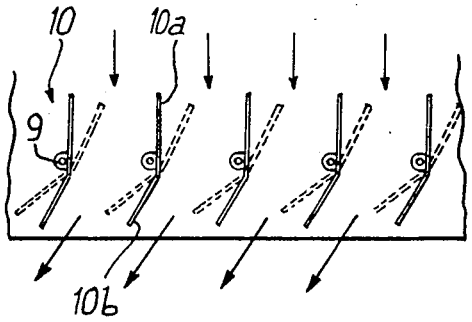
FIG. 4 is a cutaway developed view of dihedral distribution fins usable in the heater of FIG. 1.

The air distribution fins may have any appropriate shape; a planar shape is described in FIG. 3. FIG. 4 illustrates dihedrally-shaped fins 10, each comprising a vertical upper part 10*a* of greater length than lower part 10*b*, which is located closer to the outlet orifice. Lower part 10*b* is inclined with respect to vertical upper part 10*a*. Any other fin form are also contemplated, particularly curved forms.

When the unit heater is used as a heat generator, a spirally-wound battery is preferably used. This makes it possible to obtain therebeneath a homogeneous flow of hot air without turbulence.

The unit heater according to the invention may also comprise, with a view to reducing turbulence, radial blades located downstream of motor-ventilator unit 2, 3; these blades will thus serve to rectify or pre-shape the air current.

According to the foregoing description, air distribution fins 8 or 10 have been shown as being located inside the cylindrical volume defined by the wall of expansion enclosure 1. The invention also is applicable to have these fins disposed laterally with respect to the cylindrical wall of enclosure 1, i.e., outside cylindrical wall of enclosure 1, the central convex bottom 6 in that case also being extended outside the wall of expansion enclosure 1.

What is claimed:

1. An axially vertically disposed unit heater adapted to be located in a room having a floor, said heater comprising:

(a) an expansion enclosure comprising a substantially cylindrical tubular wall and an upper and a lower end, said upper and lower ends being open; and (b) a motor-ventilator unit, said unit being mounted across said open upper end of said expansion enclosure and comprising means for blowing air downwardly through said expansion enclosure, a bottom in the form of a convex dome positioned substantially centrally and extending downwardly within said lower open end, an annular space defined between said convex bottom and said tubular wall of said expansion enclosure, and a plurality of adjustably orientable distribution fins positioned within said annular space, said dome having a diameter selected in direct proportion with the height of said heater unit above said floor, said diameter comprising means for defining the limits of the range of the speed of air exiting said heater through said annular space.

2. A unit heater according to claim 1 wherein said distribution fins are uniformly spaced about a vertical axis of said unit heater and are respectively mounted to rotate about axes which are radially arranged about said vertical axis and which are horizontal with respect to said tubular wall of said expansion enclosure.

3. A unit heater according to claim 2 wherein said lower open end comprises means attached to said tubular wall of said expansion enclosure about which each of said distribution fins pivot so that each of said fins overhang in the same direction as said convex bottom, said fins being located at a short distance from the bottom of said enclosure.

4. A unit heater according to claim 2 further comprising a plurality of radial blades positioned below said motor-ventilator unit, said radial blades comprising means for reducing turbulence and rectifying air currents within said enclosure.

5. A unit heater according to claim 2 wherein said air distribution fins are planar.

6. A unit heater according to claim 2 wherein said air distribution fins are dihedral, each of said dihedral air distribution fins comprising a substantially vertical upper part and a substantially vertical lower part, said upper part being longer than said lower party and said lower part being positioned towards said lower end of said enclosure and being inclined with respect to said vertical upper part.

7. A unit heater according to claim 2 wherein said air distribution fins are disposed inside said expansion enclosure.

8. A unit heater according to claim 2 wherein said expansion enclosure further comprises a spirally-wound heating battery, said heating battery being disposed inside said expansion enclosure below said motor-ventilator unit and above said air distribution fins.

9. A unit heater according to claim 8 wherein said battery comprises a plurality of parallel fluid transport tubes.

10. A method for heating a room having a floor by destratifying layers of air of different temperatures within said room in order to provide a comfortable temperature for individuals located within said room, said method comprising using a unit heater having an expansion enclosure with a tubular wall and open upper and lower ends, a motor-ventilator unit which is mounted across said upper open end of said expansion enclosure and which comprises means for blowing air downwardly through the lower end of said expansion enclosure and into said room, and a bottom in the form of a convex dome positioned substantially centrally and extending downwardly within said open lower end, an annular space defined between said convex bottom and said tubular wall of said expansion enclosure, said motorventilator unit including a plurality of adjustably orientable distribution fins, said method comprising blowing heated air into said room in a substantially downwardly directed vertical manner towards said individuals from said open lower end, said method further comprising defining the limits of the range of the speed of air exiting from the lower end of said unit heater by selecting a diameter for said dome in direct proportion to the height of said unit heater above said floor so that said air will arrive at said individuals at a relatively low speed.

11. A method in accordance with claim 10 further comprising adjusting the speed of said air exiting from the lower end of said unit heater by varying the inclination of said plurality of distribution fins which are positioned within said enclosure and adjacent the lower end of said unit heater.

12. An axially vertically disposed unit heater adapted to be positioned within a room having a floor, said heater comprising:

(a) an expansion enclosure comprising a substantially cylindrical tubular wall, an upper end, and a lower end, said upper and lower ends being open; and (b) a motor-ventilator unit, said unit being mounted across said open upper end of said expansion enclosure and comprising means for blowing air downwardly through said expansion enclosure, a bottom plate positioned substantially centrally within said lower open end, an annular space defined between said convex bottom and said tubular wall of said expansion enclosure at said lower end, and a plurality of adjustably orientable distribution fins positioned within said annular space, said plate having a diameter selected in direct proportion to the height of said unit heater above said floor, said diameter comprising means for defining the limits of the range of the speed of air exiting from said heater through said annular space.

* * * * *

UNITED STATES PATENT AND TRADEMARK OFFICE

CERTIFICATE OF CORRECTION

PATENT NO. : 4,628,798

DATED : December 16, 1986

INVENTOR(S) : Claude TAGNON

It is certified that error appears in the above-identified patent and that said Letters Patent is hereby corrected as shown below:

At column 1, line 38, change "rte" to ---rate---;

At column 2, line 19, change "accordingly" to ---according---;

At column 2, line 32, change "whih" to ---which---;

At column 3, line 17, insert ---define--- after "them";

At column 3, line 17, change "sewing" to ---serving---;

At column 3, line 49, change "Any" to ---Many---;

At column 3, line 49, change "form" to ---forms---; and

At column 4, line 48, change "party" to ---part---.

Signed and Sealed this

Fifteenth Day of December, 1987

*Attest:*

DONALD J. QUIGG

*Attesting Officer*

*Commissioner of Patents and Trademarks*